US011794218B2

(12) United States Patent
Waller

(10) Patent No.: US 11,794,218 B2
(45) Date of Patent: Oct. 24, 2023

(54) FAUCET CLEANING ASSEMBLY

(71) Applicant: Kathy Waller, Kansas City, MO (US)

(72) Inventor: Kathy Waller, Kansas City, MO (US)

( * ) Notice: Subject to any disclaimer, the term of this patent is extended or adjusted under 35 U.S.C. 154(b) by 282 days.

(21) Appl. No.: 17/475,002

(22) Filed: Sep. 14, 2021

(65) Prior Publication Data

US 2023/0079675 A1 Mar. 16, 2023

(51) Int. Cl.

*B08B 3/08* (2006.01)
*B05B 15/55* (2018.01)
*B05B 15/52* (2018.01)

(52) U.S. Cl.

CPC ..... *B08B 3/08* (2013.01); *B05B 15/52* (2018.02); *B05B 15/55* (2018.02)

(58) Field of Classification Search

CPC ..... B08B 3/08; B08B 9/021; B05B 15/52; B05B 15/55; E03C 1/0404; E03C 2201/70

USPC ..... 4/255.01, 694; 68/216; 15/104.3, 406; 38/89–90; 137/240; 134/22.11, 24, 166, 134/167, 168.1

See application file for complete search history.

(56) References Cited

U.S. PATENT DOCUMENTS 2,304,456 A 12/1942 Hall
2,688,515 A 9/1954 Filliung
3,064,275 A 11/1962 Allen
4,204,361 A * 5/1980 Chaput ..... A63H 3/52 446/74
4,313,564 A 2/1982 Shames
5,002,069 A * 3/1991 Thompson ..... A61B 46/00 128/853
5,394,989 A * 3/1995 Delson ..... A61C 19/008 206/83
9,643,833 B2 * 5/2017 Smith ..... B67D 3/0054
10,816,124 B2 * 10/2020 Molineux ..... F16K 3/30
2003/0034055 A1 * 2/2003 Deecki ..... A61F 5/445 134/22.18
2006/0011740 A1 1/2006 Bosio
2007/0048063 A1 * 3/2007 Bauer ..... A47K 7/03 401/7
2009/0099488 A1 * 4/2009 Hedberg ..... A61F 7/02 601/16
2010/0186146 A1 * 7/2010 Askew ..... A45D 44/12 2/209
2016/0122081 A1 * 5/2016 Perkins ..... B65B 5/08 53/469

(Continued)

FOREIGN PATENT DOCUMENTS

CA 3079700 A1 * 10/2021 ..... A41D 19/0024
EP 577063 A1 * 1/1994 ..... A61B 17/00234

(Continued)

*Primary Examiner* — Lori L Baker

(57) ABSTRACT

A faucet cleaning assembly includes a pouch which has an inner layer and an outer layer. The inner layer is comprised of a fluid impermeable material defining an interior of the pouch thereby facilitating the interior of the pouch to contain an acidic solution. The pouch is positionable around a faucet thereby facilitating the acidic solution to dissolve mineral deposits on the faucet. A band is integrated into the pouch and a drawstring is integrated into the band. The band is collapsible when the drawstring is tightened for retaining the pouch on the faucet. A lock is slidably disposed on the drawstring to retain the drawstring in a tightened condition for retaining the band around the faucet.

6 Claims, 5 Drawing Sheets

(56) References Cited

U.S. PATENT DOCUMENTS

| | | | | |
|---|---|---|---|---|
| 2016/0136404 | A1* | 5/2016 | Moore | A61M 35/10 604/290 |
| 2017/0072271 | A1* | 3/2017 | Betz | A63B 57/60 |
| 2018/0009587 | A1* | 1/2018 | Mosser | B65D 75/5855 |
| 2019/0023555 | A1* | 1/2019 | Smith | B67D 3/041 |
| 2021/0330003 | A1* | 10/2021 | Brown | A41D 19/002 |
| 2021/0369898 | A1* | 12/2021 | Dornau | A61L 2/20 |
| 2023/0079675 | A1* | 3/2023 | Waller | B05B 15/52 4/255.01 |

FOREIGN PATENT DOCUMENTS

| | | | | |
|---|---|---|---|---|
| WO | WO-2007027277 | A1 * | 3/2007 | A47K 7/03 |
| WO | WO-2018007902 | A1 * | 1/2018 | A61J 1/00 |

* cited by examiner

FAUCET CLEANING ASSEMBLY

STATEMENT REGARDING FEDERALLY SPONSORED RESEARCH OR DEVELOPMENT

Not Applicable

CROSS-REFERENCE TO RELATED APPLICATIONS

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to faucet cleaning devices and more particularly pertains to a new faucet cleaning device for dissolving mineral deposits on a faucet. The device includes a pouch that is comprised of a fluid impermeable inner layer and a textile outer layer such that the pouch can contain an acidic solution. A drawstring is integrated into the pouch for tightening the pouch around a faucet. In this way the acidic solution can dissolve mineral deposits on the faucet.

(2) Description of Related Art Including Information Disclosed Under 37 CFR 1.97 and 1.98

The prior art relates to faucet cleaning devices including a variety of self cleaning faucets that are designed to inhibit the collection of mineral deposits therein. The prior art discloses a fluid fitting for attaching to a pressure washer to facilitate a sink drain to be cleaned. The prior art discloses a scraper device for abrading mineral deposits from a faucet.

BRIEF SUMMARY OF THE INVENTION

An embodiment of the disclosure meets the needs presented above by generally comprising a pouch which has an inner layer and an outer layer. The inner layer is comprised of a fluid impermeable material defining an interior of the pouch thereby facilitating the interior of the pouch to contain an acidic solution. The pouch is positionable around a faucet thereby facilitating the acidic solution to dissolve mineral deposits on the faucet. A band is coupled to the pouch and a drawstring is integrated into the band. The band is collapsible when the drawstring is tightened for retaining the pouch on the faucet. A lock is slidably disposed on the drawstring to retain the drawstring in a tightened condition for retaining the band around the faucet.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
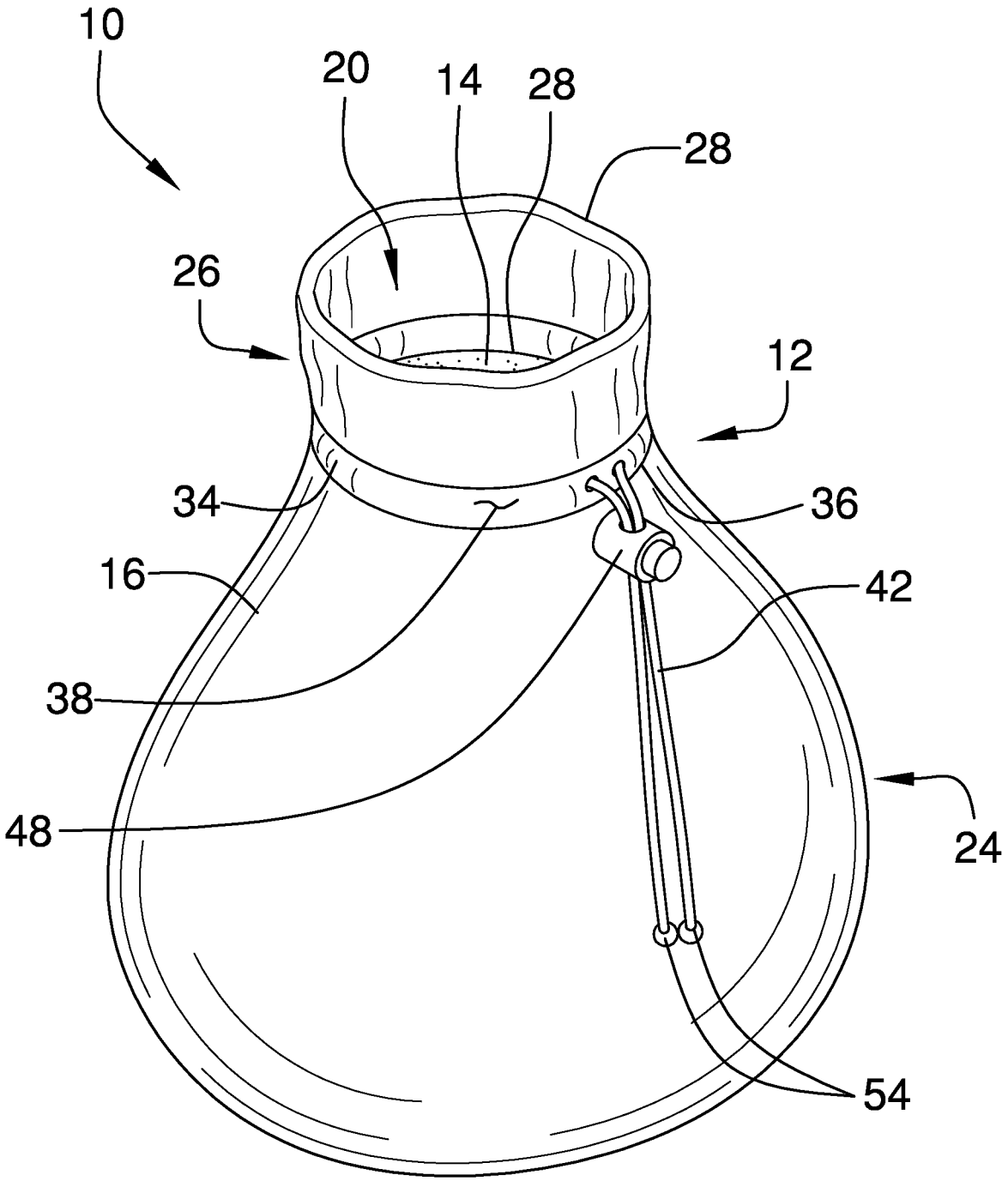
FIG. 1 is a top perspective view of a faucet cleaning assembly according to an embodiment of the disclosure.
Figure 2:
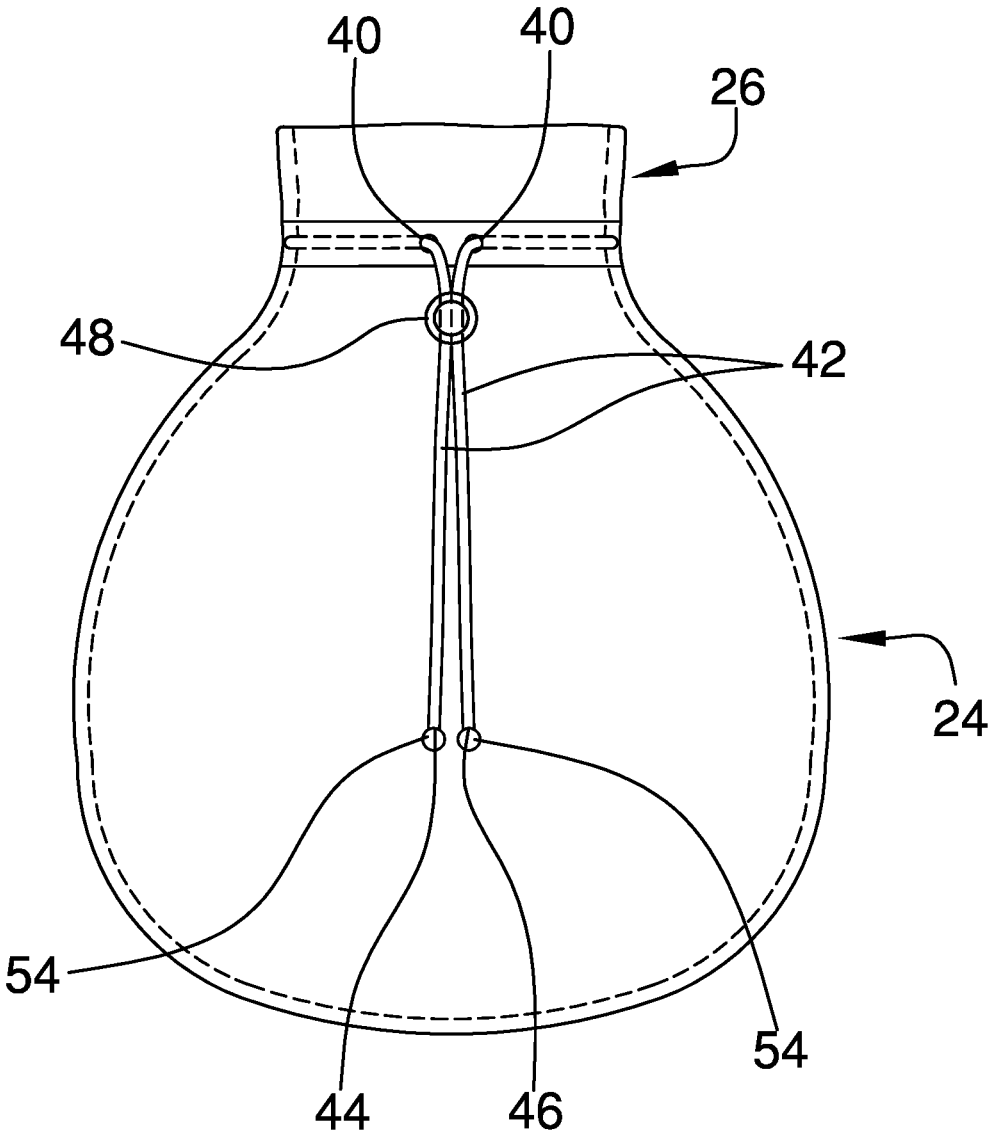
FIG. 2 is a front phantom view of an embodiment of the disclosure.
Figure 3:
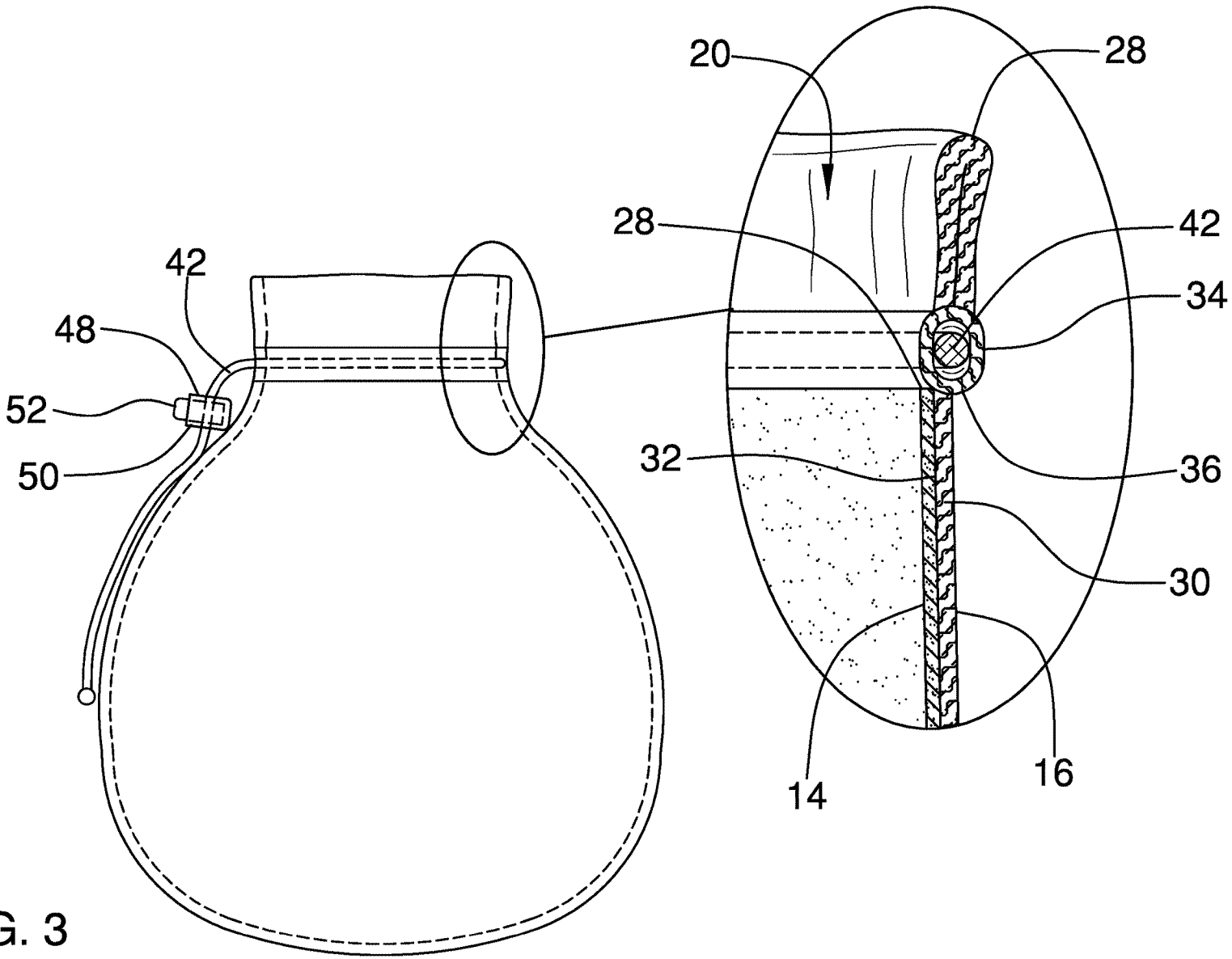
FIG. 3 is a left side phantom view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the faucet cleaning assembly 10 generally comprises a pouch 12 that has an inner layer 14 and an outer layer 16. The inner layer 14 is comprised of a fluid impermeable material, including but not being limited to, rubber, silicone, vinyl or other similar type of deformable and fluid impermeable material. The inner layer 14 defines an interior of the pouch 12 thereby facilitating the interior of the pouch 12 to contain an acidic solution 18. The acidic solution 18 may comprise vinegar or other similarly weak acidic solution that is not harmful to human skin but can dissolve mineral deposits commonly associated with hard water. The outer layer 16 is comprised of a textile material such as cotton or other similar type of textile.

The pouch 12 has an entrance 20 extending into the interior of the pouch 12 to facilitate a faucet 22 to be extended through the opening thereby facilitating the acidic solution 18 to dissolve mineral deposits on the faucet 22. The faucet 22 may comprise a kitchen sink faucet, a shower head or other type of plumbing fixture that is employed for releasing water. The pouch 12 has a body portion 24 and a neck portion 26, and the body portion 24 flares outwardly from the neck portion 26 having the neck portion 26 tapering upwardly from the body portion 24. Moreover, the pouch 12 may have a bulbous shape that is similar to that of a conical flask.

Each of the inner layer 14 and the outer layer 16 has an upper edge 28, and the inner layer 14 has an outer surface 30. The outer layer 16 has an inner surface 32 and the inner surface 32 of the outer layer 16 conforms to the outer surface 30 of the inner layer 14. The upper edge 28 of the inner layer 14 is spaced downwardly from the upper edge 28 of the outer layer 16. Furthermore, the upper edge 28 of the outer layer 16 defines the entrance 20 into the pouch 12.

A band 34 is integrated into the pouch 12 and the band 34 is spaced downwardly from the entrance 20 of the pouch 12. The band 34 is hollow and the band 34 has a lower edge 36 and an outer facing surface 38. The lower edge 36 is aligned with the upper edge 28 of the inner layer 14. Furthermore, the outer facing surface 38 has a pair of openings 40 each extending through the outer facing surface 38 and into an interior of the band 34 and the band 34 is comprised of a deformable material.

A drawstring 42 is provided and the drawstring 42 is integrated into the band 34. The band 34 is collapsible when the drawstring 42 is tightened such that the band 34 tightens around the faucet 22 when the faucet 22 is extended through the entrance 20 into the pouch 12. In this way the pouch 12 is retained on the faucet 22. The drawstring 42 is positioned in the interior of the band 34 and the drawstring 42 has a first end 44 and a second end 46. The drawstring 42 extends through each of the openings 40 in the outer facing surface 38 of the band 34 such that each of the first end 44 and the second end 46 is exposed.

A lock 48 is slidably disposed on the drawstring 42 and the lock 48 is biased into a locking condition having the lock 48 engaging the drawstring 42. In this way the lock 48 can retain the drawstring 42 in a tightened condition to retain the band 34 around the faucet 22. The lock 48 is urgeable into an unlocked condition having the lock 48 disengaging the drawstring 42 for loosening the drawstring 42. In this way the lock 48 can facilitate the band 34 to be removed from the faucet 22.

The lock 48 comprises a cylinder 50 that has the drawstring 42 extending through the cylinder 50. The lock 48 includes a button 52 that is movably integrated into the cylinder 50. The button 52 is biased to frictionally engage the drawstring 42 and the button 52 is depressible to disengage the drawstring 42. A pair of balls 54 is each coupled to a respective of one of the first end 44 and the second end 46 of the drawstring 42 thereby inhibiting the drawstring 42 from being removed from the lock 48.

Figure 4:
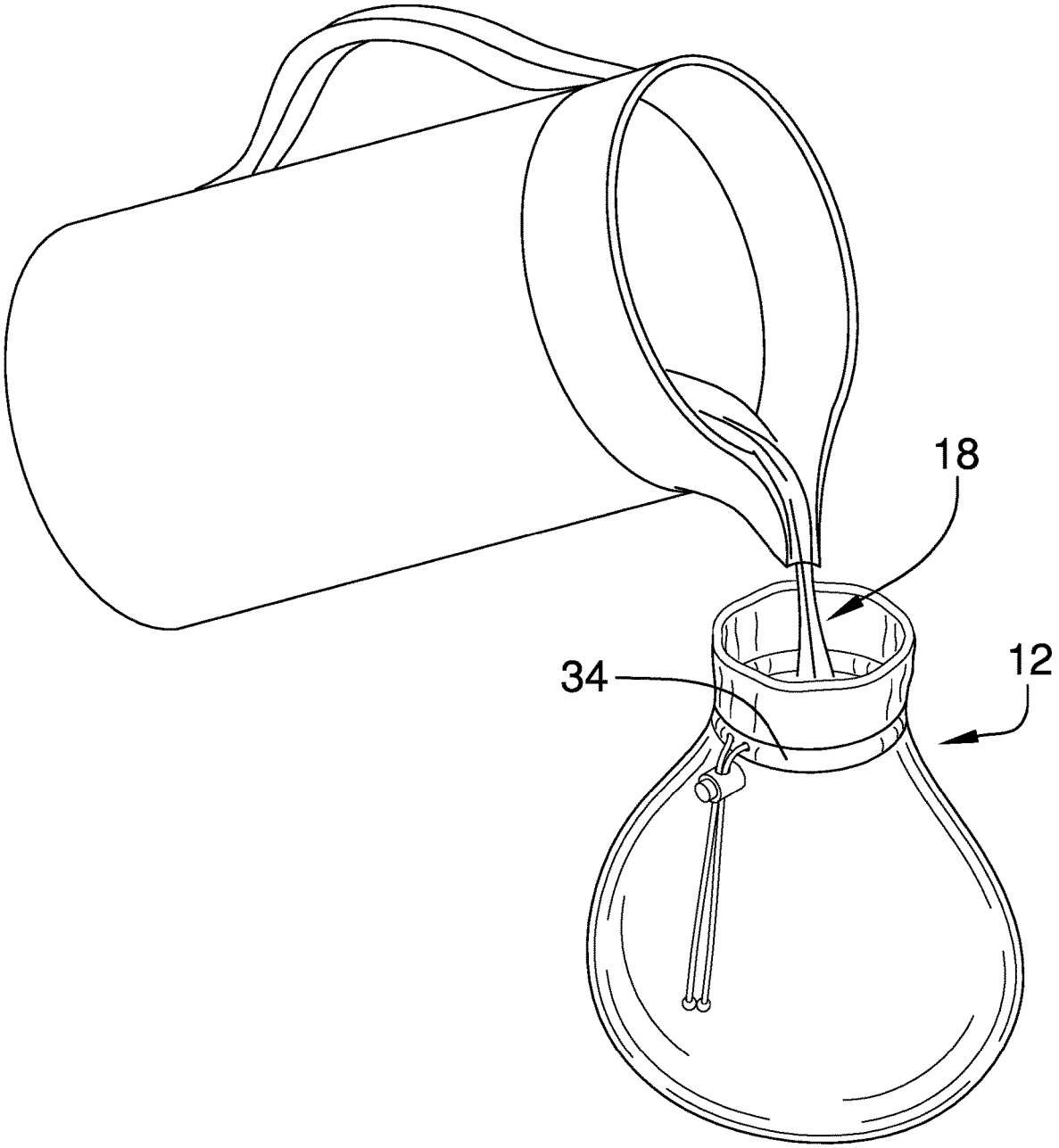
FIG. 4 is a perspective view of an embodiment of the disclosure showing a pouch being filled with an acidic solution.
Figure 5:
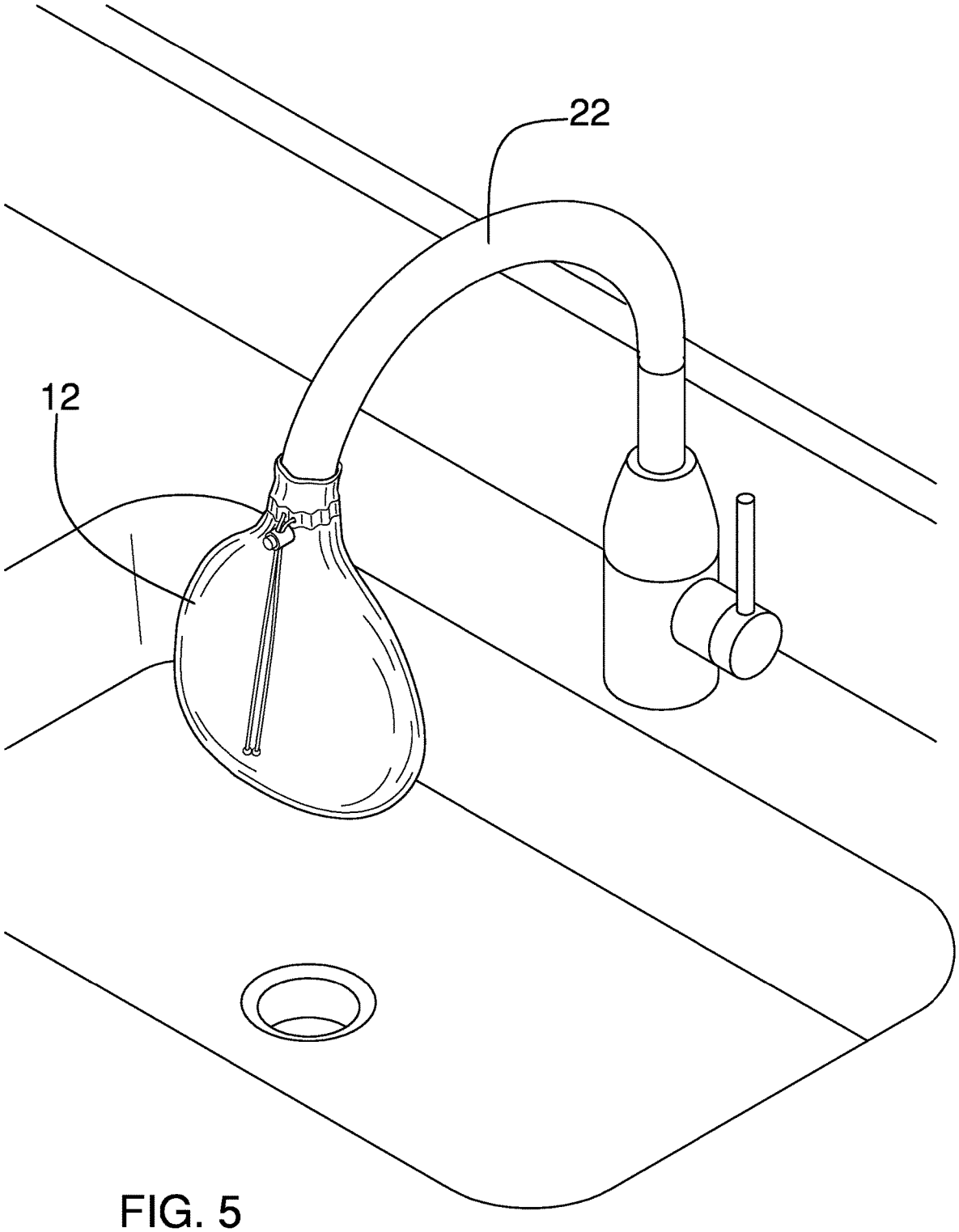
FIG. 5 is a perspective in-use view of an embodiment of the disclosure.

In use, as is most clearly shown in FIG. 4, the acidic solution 18 is poured into the pouch 12 and the pouch 12 is positioned around the faucet 22. The drawstring 42 is tightened to close the band 34 around the faucet 22 to retain the pouch 12 on the faucet 22. In this way the faucet 22 can be submerged in the acid solution 18 to dissolve mineral deposits that have collected on the faucet 22. Furthermore, the pouch 12 is left on the faucet 22 for a sufficient duration of time to dissolve the mineral deposits. In this way the faucet 22 can be cleaned of the mineral deposits to facilitate the faucet 22 to function normally with respect to delivering water from the faucet 22. The drawstring 42 is loosened and the pouch 12 is removed from the faucet 22 when the mineral deposits have been fully dissolved.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A faucet cleaning assembly for submerging a faucet in a cleaning solution for cleaning the faucet, said assembly comprising:

a pouch having an inner layer and an outer layer, said inner layer being comprised of a fluid impermeable material defining an interior of said pouch thereby facilitating said interior of said pouch to contain an acidic solution, said outer layer being comprised of a textile material, said pouch having an entrance extending into said interior of said pouch wherein said entrance is configured to have a faucet extended through said opening thereby facilitating said acidic solution to dissolve mineral deposits on the faucet;

a band being integrated into said pouch, said band extending around said pouch, said band being hollow;

a drawstring being integrated into said band, said band being collapsible when said drawstring is tightened wherein said band is configured to be tightened around the faucet when the faucet is extended through said entrance into said pouch for retaining said pouch on the faucet;

a lock being slidably disposed on said drawstring, said lock being biased into a locking condition having said lock engaging said drawstring thereby facilitating said lock to retain said drawstring in a tightened condition wherein said lock is configured to retain said band around the faucet, said lock being urgeable into an unlocked condition having said lock disengaging said drawstring for loosening said drawstring wherein said lock is configured to facilitate said band to be removed from the faucet.

2. The assembly according to claim 1, wherein said pouch has a body portion and a neck portion, said body portion flaring outwardly from said neck portion having said neck portion tapering upwardly from said body portion, each of said inner layer and said outer layer having an upper edge, said upper edge of said inner layer being spaced downwardly from said upper edge of said outer layer, said inner layer having an outer surface, said outer layer having an inner surface, said inner surface of said outer layer conforming to said outer surface of said inner layer, said upper edge of said outer layer defining said entrance into said pouch.

3. The assembly according to claim 2, wherein said band has a lower edge and an outer facing surface, said lower edge being aligned with said upper edge of said inner layer, said outer facing surface having a pair of openings each extending through said outer facing surface an into an interior of said band, said band being comprised of a deformable material.

4. The assembly according to claim 3, wherein said drawstring is positioned in said interior of said band, said drawstring having a first end and a second end, said drawstring extending through each of said openings in said outer facing surface of said band such that each of said first end and said second end is exposed.

5. The assembly according to claim 1, wherein:

said lock comprises:

a cylinder having said drawstring extending through said cylinder; and a button being movably integrated into said cylinder, said button being biased to frictionally engage said drawstring, said button being depressible to disengage said drawstring; and a pair of balls, each of said balls being coupled to a respective one of a first end and a second end of said drawstring thereby inhibiting said drawstring from being removed from said lock.

6. A faucet cleaning assembly for submerging a faucet in a cleaning solution for cleaning the faucet, said assembly comprising:

a pouch having an inner layer and an outer layer, said inner layer being comprised of a fluid impermeable material defining an interior of said pouch thereby facilitating said interior of said pouch to contain an acidic solution, said outer layer being comprised of a textile material, said pouch having an entrance extending into said interior of said pouch wherein said entrance is configured to have a faucet extended through said opening thereby facilitating said acidic solution to dissolve mineral deposits on the faucet, said pouch has a body portion and a neck portion, said body portion flaring outwardly from said neck portion having said neck portion tapering upwardly from said body portion, each of said inner layer and said outer layer having an upper edge, said upper edge of said inner layer being spaced downwardly from said upper edge of said outer layer, said inner layer having an outer surface, said outer layer having an inner surface, said inner surface of said outer layer conforming to said outer surface of said inner layer, said upper edge of said outer layer defining said entrance into said pouch;

a band being integrated into said pouch, said band being spaced downwardly from said entrance of said pouch, said band being hollow, said band having a lower edge and an outer facing surface, said lower edge being aligned with said upper edge of said inner layer, said outer facing surface having a pair of openings each extending through said outer facing surface an into an interior of said band, said band being comprised of a deformable material;

a drawstring being integrated into said band, said band being collapsible when said drawstring is tightened wherein said band is configured to be tightened around the faucet when the faucet is extended through said entrance into said pouch for retaining said pouch on the faucet, said drawstring being positioned in said interior of said band, said drawstring having a first end and a second end, said drawstring extending through each of said openings in said outer facing surface of said band such that each of said first end and said second end is exposed;

a lock being slidably disposed on said drawstring, said lock being biased into a locking condition having said lock engaging said drawstring thereby facilitating said lock to retain said drawstring in a tightened condition wherein said lock is configured to retain said band around the faucet, said lock being urgeable into an unlocked condition having said lock disengaging said drawstring for loosening said drawstring wherein said lock is configured to facilitate said band to be removed from the faucet, said lock comprising:

a cylinder having said drawstring extending through said cylinder; and a button being movably integrated into said cylinder, said button being biased to frictionally engage said drawstring, said button being depressible to disengage said drawstring; and a pair of balls, each of said balls being coupled to a respective one of said first end and said second end of said drawstring thereby inhibiting said drawstring from being removed from said lock.

* * * * *